US006745493B2

(12) United States Patent
Malachowski et al.

(10) Patent No.: US 6,745,493 B2
(45) Date of Patent: Jun. 8, 2004

(54) SYSTEM AND METHOD FOR DRYING TONER PARTICLES

(75) Inventors: Steven M. Malachowski, East Rochester, NY (US); Chieh-Min Cheng, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/244,453

(22) Filed: Sep. 16, 2002

(65) Prior Publication Data

US 2004/0049941 A1 Mar. 18, 2004

(51) Int. Cl.[7] ..... F26B 7/00
(52) U.S. Cl. ..... 34/386; 34/505; 430/137.1
(58) Field of Search ..... 34/313, 315, 328, 34/363, 368, 369, 386, 493, 495, 505; 430/137.1

(56) References Cited

U.S. PATENT DOCUMENTS 3,632,257 A * 1/1972 Ashizawa ..... 425/222
4,245,396 A 1/1981 Maffet ..... 34/12
4,251,367 A 2/1981 Santora ..... 210/702
4,489,503 A * 12/1984 Browne et al. ..... 34/368
4,736,527 A * 4/1988 Iwamoto et al. ..... 34/594
5,007,181 A 4/1991 Jackson et al. ..... 34/57 R
5,032,222 A * 7/1991 Millioud ..... 159/4.1
6,207,339 B1 * 3/2001 Kato et al. ..... 430/138

* cited by examiner

*Primary Examiner*—Henry Bennett
*Assistant Examiner*—Andrea M. Ragonese
(74) *Attorney, Agent, or Firm*—Fay, Sharpe, Fagan, Minnich & McKee, LLP

(57) ABSTRACT

A method of drying wet toner particles includes adding different sized wet toner particles to a dryer drying chamber and drying each of the wet toner particles for a drying time $T_D$. The drying time $T_D$ can vary for each toner particle and is proportional to the mass of the wet toner particle. The method can also include introducing a heated drying gas into the drying chamber to create a circulating flow of drying gas. The method also includes adjusting the pressure and/or velocity and/or angle of the heated drying gas to control the amount of deagglomeration of the toner particles.

32 Claims, 4 Drawing Sheets

SYSTEM AND METHOD FOR DRYING TONER PARTICLES

BACKGROUND OF THE INVENTION

The present invention relates to a system and method of drying chemical toner particles, and more particularly a system and method for drying chemical toner particles in a circulating flow of drying gas.

Chemical toner used in copiers is composed of toner particles which are applied to paper to produce an image. It is desirable that the toner particles be uniformly sized, having a narrow size distribution, to produce images with improved resolution and clarity. For example, in one known application, solid toner particles are produced having a typical average size distribution of approximately 6 microns in diameter with most particles falling in a range of about 2 to 8 microns.

It is also desirable that the toner particles flow freely during use to provide superior results. Moisture retained by the toner particles can cause the particles to stick together and not flow freely. During the process of manufacturing toner, the toner particles are dried until they have a moisture content sufficiently low enough that the toner particles do not stick together.

The toner particles are separated from each other in a process called deagglomeration. During drying, sufficient deagglomeration exposes the surface of each particle to enable efficient heat transfer from the particle which also aids in drying.

In a conventional process of forming chemical toner, latex particles and pigment particles are heated in a chemical reactor to form covalent bonds between the particles. The covalent bonds provide attractive forces between the particles causing them to come together or aggregate. The aggregated particles are then coalesced to make them more robust.

At this point in the process, the particles are in a liquid dispersion, also known as a mother liquor, which includes the toner particles, as well as residuals such as latex, pigment, surfactants, and other materials used in the process. Next, the mother liquor is dewatered from the particles to obtain a slurry including the solid toner particles as well as residuals including surfactants used to stabilize the latex, pigments and waxes. The wetcake is then washed to remove more of the residuals. The wetcake may be washed several times.

The washed toner particles, or wetcake, is then dried to provide free-flowing individual toner particles. Several different processes have been used for drying the toner particles, including indirect dryers such as disc dryers, drum dryers, paddle dryers, rotary dryers, and direct dryers including vacuum, freeze fluid bed and conveyers.

The wetcake includes a large number of different sized wet toner particles. Further, the moisture retained by each wet particle is typically proportional to the particle size, so that larger particles retain more moisture than smaller particles. A problem with conventional toner particle drying systems and methods, is that the drying time for each particle, that is the length of time each particle is dried, is approximately equal. Thus moisture retained by the particles is not removed in an effective and efficient manner. In order to remove enough of the moisture from the larger particles, conventional drying apparatus and processes often dry the smaller particles for too long, overheating them above their glass transition point (Tg).

Toner particles heated above their glass transition point (Tg) or melting point (Tm), can fuse with other particles. The fused toner particle clumps have sizes which exceed the desired range of particle size resulting in poor toner performance. It is desirable to dry each toner particle to remove the desired amount of moisture while preventing overheating which can result in the undesirable fusion of toner particles.

Additionally, the feed material enters the drying system as a de-lumped wetcake, and needs to be separated further to produce a free flowing product. Conventional toner drying technologies provide limited deagglomeration capabilities. It is desirable to improve deagglomeration during drying.

SUMMARY OF THE INVENTION

A system and method of drying wet toner particles used for hard-copy document and image reproduction.

In accordance with a first aspect of the invention a method of drying wet toner particles is provided. The method includes adding different sized wet toner particles to a dryer drying chamber and drying each of the wet toner particles for a drying time $T_D$. The drying time $T_D$ can vary for each toner particle and is proportional to the mass of the wet toner particle.

In accordance with a second aspect of the invention, the method can include introducing a heated drying gas into the drying chamber to create a circulating flow of drying gas having a curved portion, and retaining the toner particles in the circulating flow until the toner particles lose enough moisture that exiting forces overcome centrifugal forces and the toner particles no longer remain in the drying chamber.

In accordance with another aspect of the invention, a dryer for drying toner particles is included. The dryer includes a drying chamber, at least one drying gas inlet for introducing heated drying gas into the drying chamber to produce a circulating flow of drying gas. The dryer includes a feed inlet for introducing wet toner particles into the circulating flow of drying gas to dry the wet toner particles. The dryer also includes an exit path communicating with the drying chamber for directing an exiting stream of the drying gas out of the drying chamber to move dry toner particles from the drying chamber.

Other features, benefits and advantages of this invention will become apparent to those skilled in the art from the following detailed description of the preferred embodiments, when read in light of the accompanying drawings.

BRIEF DESCRIPTION OF THE DRAWINGS

The drawings are only for purposes of illustrating preferred embodiments and are not to be construed as limiting the invention. The invention may take form in various components and arrangements of components, and in various steps and arrangements of steps, preferred embodiments of which will be illustrated in the accompanying drawings wherein.

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific examples and characteristics relating to the embodiments disclosed herein are not to be considered as limiting, unless the claims expressly state otherwise.

A method and apparatus for drying chemical toner particles, such as emulsion aggregate chemical toner particles including styrene-acrylate toner particles, polyester toner particles or any other suitable known toner particles is provided. The chemical toner particles are typically uniformly sized with the majority having a diameter falling into a predetermined range. As an example, which should not be considered limiting, the invention can be used to dry wet toner particles having sizes between 2 and 8 microns, although any suitable sizes of known toner particles can be used. The wet toner particles can be produced in any known manner and can have any suitable conventional moisture content, often expressed as a percent by weight of moisture. One example of the moisture content of the wet toner particles, which should not be considered as limiting, can be about 20% to about 40% by weight, and more preferably from about 25% to about 35% by weight, although any suitable moisture content can be used.

Figure 1:
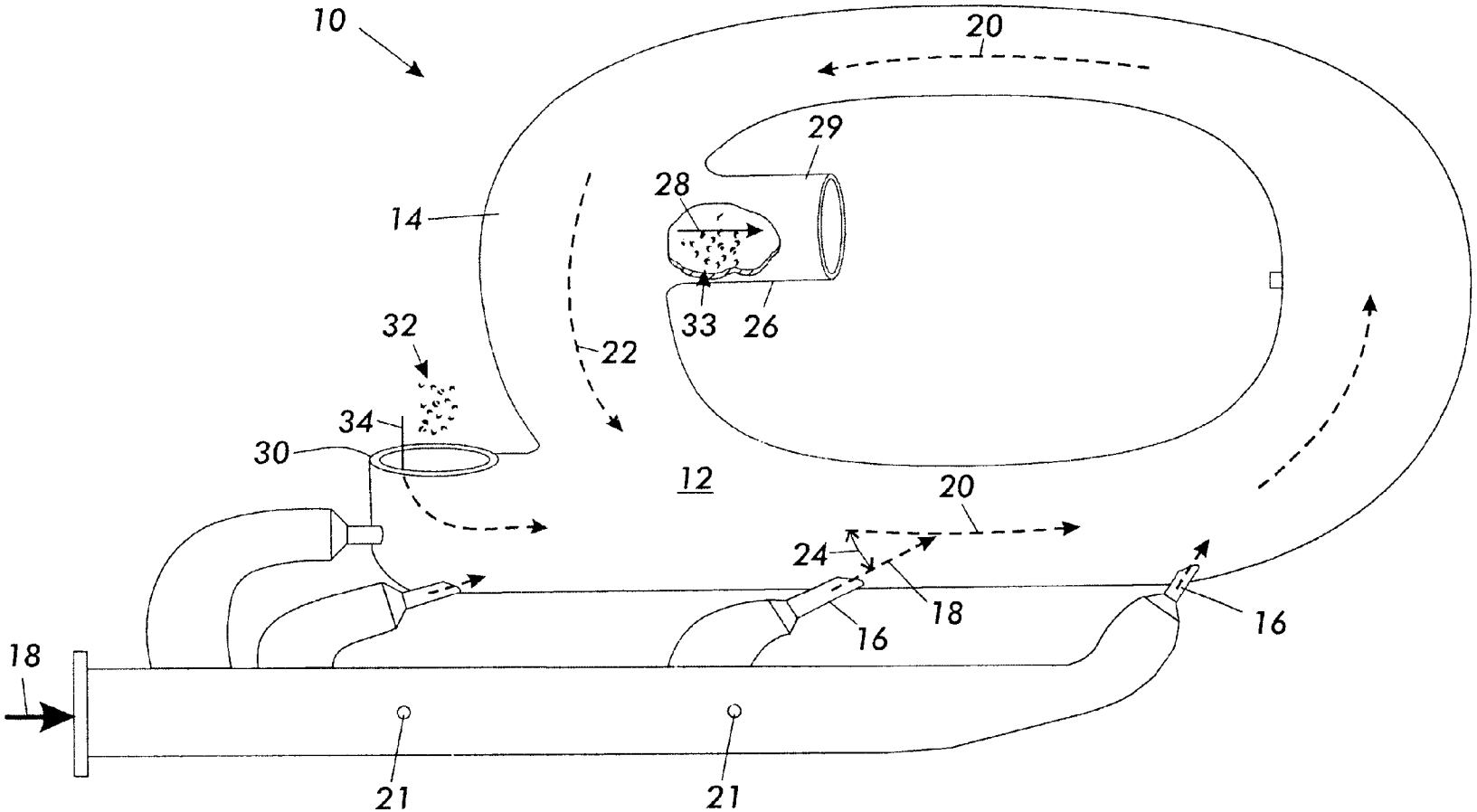
FIG. 1 is diagram illustrating a dryer in accordance with the invention.

Referring to FIG. 1 a dryer for drying toner particles is shown generally at 10. The dryer 10 includes a drying chamber 12 in which the toner particles are dried. The drying chamber includes a curved portion 14 and can have a circular shape, a toroidal shape or any other suitable shape having a curved portion. Toroidal dryers have been used to dry materials such as waste products. Examples of toroidal flash dryers include the Aljet models made by Fluid Energy of Telford, Penn. However, these toroidal dryers have not been used to dry heat sensitive materials, having melting points Tm and glass transition points Tg which adversely affect the resulting dried products.

The dryer 10 further includes at least one drying gas inlet 16 extending into the drying chamber 12 for introducing heated drying gas, shown by arrow 18, into the drying chamber 12 to produce a circulating flow of drying gas shown generally by arrow 20 The dryer 10 can include a plurality of the drying gas inlets 16.

The drying gas 18 is heated to a pre-determined temperature and pressurized to create a high velocity circulating flow 20. The pressure and temperature of the drying gas 18 can be monitored at monitor points 21. Temperatures of about 15 degrees Celsius (° C.) to about 40° C. above the exiting stream temperature (as described below), and more preferably about 20° C. to about 35° C. above the exiting stream temperatures have been found to be effective, although any suitable inlet stream temperatures can be used. Inlet pressures from about 1.0 pounds per square inch psi) to 5.0 psi, and more preferably from about 1.0 psi to 1.5 psi have been shown to provide suitable circulating flow velocities, although any suitable inlet pressures can be used. Flow velocities of about 3,000 feet per minute (fpm) to 5,000 fpm, and more preferably 3,800 fpm to 4,200 fpm have been found to be effective for drying and deagglomerating the wet toner particles 32, although any suitable flow velocities can be used.

The drying gas inlet 16 is preferably angled with respect to the circulating flow 20 as shown at 24 to produce the circulating flow. The angle 24 is preferably less than 90 degrees, although any suitable angle, including an angle of 0 degrees may be used. The circulating flow 20 circulates in the drying chamber 12 in a circular flow as shown by the arrows 20 and 22. The circulating flow 20 includes a curved portion 22 flowing through the curved portion 14 of the drying chamber 12.

The dryer 10 includes an exit path 26 communicating with the drying chamber 12 for directing an exiting stream of the drying gas, shown by arrow 28, out of the drying chamber 12. The exit path 26 extends at approximately a right angle from the curved portion of the drying chamber 14 so that the exiting stream 28 forms an angle with the curved portion 22 of the circular flow. The angle can be approximately a right angle, although it has been found that varying this angle can create or reduce turbulence and affect the material cut point by size or mass. Accordingly, any suitable angle size may be used to produce the results desired.

The dryer 10 also includes a feed inlet 30 for introducing a feed of wet toner particles 32 into the circulating flow of drying gas 20 within the drying chamber 12 as shown by arrow 34 for drying. Any suitable known method and/or apparatus can be used for introducing the feed of wet toner particles 32, such as for example, a rotary valve or venturi injection.

Figure 2:
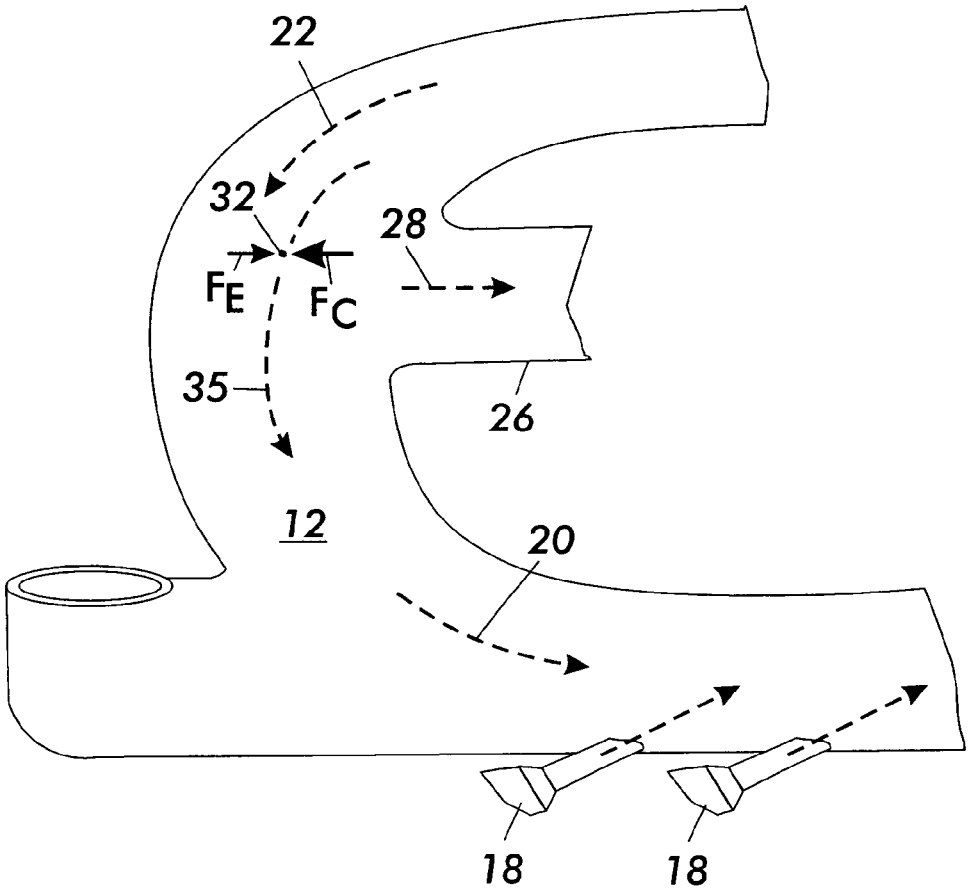
FIG. 2 is diagram of a portion of the dryer show in FIG. 1 illustrating the forces exerted on a toner particle when the toner particle remains in the circulating stream in accordance with the invention.
Figure 3:
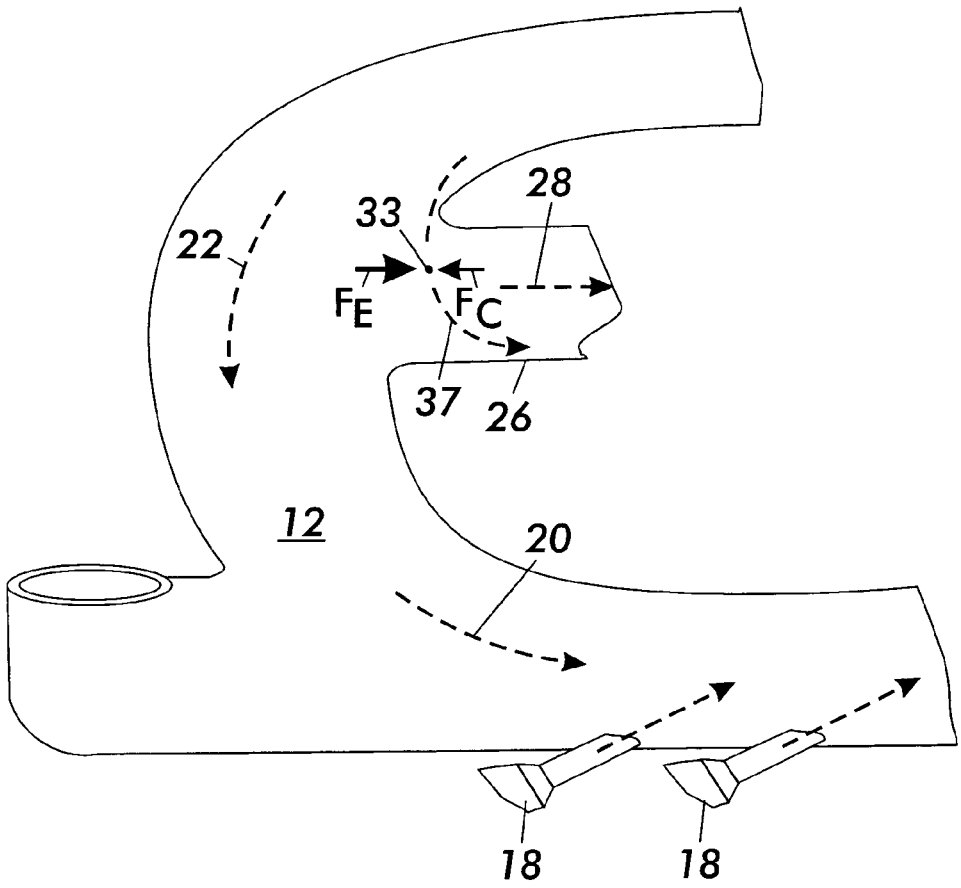
FIG. 3 is diagram of a portion of the dryer show in FIG. 1 illustrating the forces exerted on a toner particle when the toner particle exits the drying chamber in accordance with the invention.

Referring now to FIGS. 2 and 3, the operation of the dryer 10 shall be described. The feed of wet toner particles 32 introduced into the feed inlet 30 are carried through the drying chamber 12 by the circulating flow of drying gas 20. The circulating flow 20 deagglomerates the feed of wet toner particles 32 separating them into individual particles. The wet toner particles 32 are flash dried while they remain in the circulating flow of drying gas 20 within the drying chamber 12 for the drying time $T_D$. Evaporative cooling helps protect the particles from fusing together.

As the wet toner particles 32 travel through the curved portion 14 of the drying chamber 12 in the curved portion of the circulating flow 22, centrifugal forces $F_C$ are produced on the toner particles. Further, as the toner particles 32 in the curved flow 22 travel past the exiting stream 28, exiting forces $F_E$ such as centripetal forces due to frictional drag from the exit stream 26, are produced on the particles. The exiting forces $F_E$ urge the particles to move into the exiting stream 28 and be carried through the exit path 26 and out of the drying chamber 12. The exit path 26 is constructed an form an angle of approximately 90 degrees with the curved portion 14 so that the exiting stream 28 is forms an angle of approximately 90 degrees with the curved flow 22. As a result, the centrifugal forces $F_C$ on the particles oppose the exiting forces $F_E$. Although, as stated above, angles of other magnitudes can be used.

Wet toner particles 32 have more mass than similarly sized dry toner particles because they retain more water. Therefore, the wet toner particles 32 traveling around the curved portion 14 in the curved flow 22 experience greater centrifugal forces $F_C$ than dry toner particles. The larger centrifugal forces $F_C$ exerted on the wet toner particles 32 overcome the exiting forces $F_E$ exerted on these particles and keep the wet toner particles in the circulating flow of drying gas 22 for further drying as shown by the dashed arrow 35.

As the toner particles dry, they retain less water and thus have less mass. As the mass of the drying toner particle decreases, the centrifugal forces $F_C$ exerted on the toner particles in the curved portion of the circulating flow 22 decreases. When the toner particles are dry, as shown at 33, having a predetermined desired moisture content the centrifugal forces $F_C$ no longer are large enough to overcome the exiting forces $F_E$ and keep the toner particles in the circulating flow of drying gas within the drying chamber 12 of the dryer 10. The exiting forces $F_E$ urge the dry toner particles 33 to move into the exiting stream 28 and be carried out of the drying chamber 12 as shown by the dashed arrow 37. The dry toner particles 33 are collected from the exiting stream 28 by cyclonic collection methods, using a bag house or dust collector, or in any suitable known manner of collecting particles from a flowing stream of gas.

Each of the particles remain in the circulating flow 20 in the drying chamber 12 for the drying time $T_D$ which can vary from particle to particle. The drying time $T_D$ for each wet toner particle is proportional to the mass of the toner particle. The mass of each wet toner particle 32 includes the mass of the toner particle and the mass of the water retained by the toner particle.

The drying time $T_D$ for each toner particle is thus proportional to the size of the toner particle so that a larger toner particle is dried for a longer drying time than a smaller toner particle. Further, since the amount of moisture retained by the toner particle is proportional to the size of the toner particle, the drying time $T_D$ is generally proportional to the amount of moisture retained by the toner particle. Therefore, a toner particle retaining more water is dried for a longer drying time than a toner particle retaining less water.

The exiting stream 28 is monitored at 29 to maintain the temperature of the exiting stream below the Tg or Tm of the toner particles. The exiting stream temperature has been shown to determine the final moisture content of the dry toner particles, with a higher temperature providing a lower final moisture content. Effective exiting stream temperatures have been found to be in the range of about 12° C. below Tg to about 1° C. above Tg, and more preferably from about 8° C. to about 3° C. below Tg, although any suitable exiting stream temperatures can be used.

The dry toner particles are collected in any suitable known manner such as by cyclonic collection methods or using a bag house or dust collector.

Figure 4:
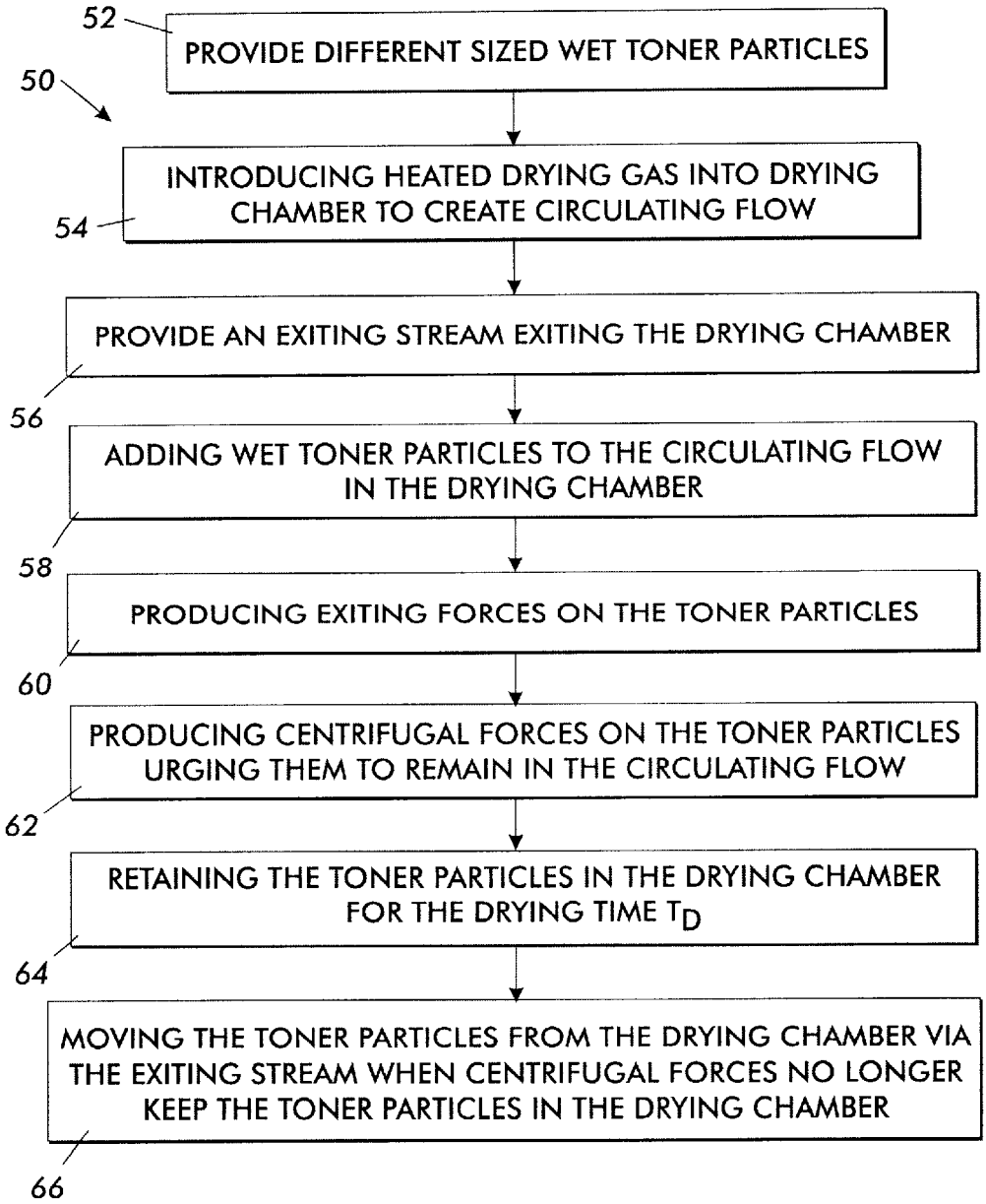
FIG. 4. illustrates the steps of the invention.

Referring now to FIG. 4, the method of drying wet chemical toner particles is shown generally at 50. The method includes providing different sized wet toner particles to be dried, such as those described above, at 52. The wet toner particles are added to a dryer at 58 and dried for a drying time $T_D$ at 64. The drying $T_D$ is proportional to the size of the toner particle so that a larger toner particle is dried for a longer drying time than a smaller toner particle. The drying time $T_D$ is also proportional to the amount of moisture retained by each toner particle so that a toner particle retaining more water is dried for a longer drying time than a toner particle retaining less water.

The method of drying toner particles can also include introducing a heated drying gas into the drying chamber of a dryer to create a circulating flow of drying gas within the dryer at 54. The circulating flow preferably includes a curved portion as described above. The adding step can also include introducing the wet toner particles into the circulating flow of drying gas.

The method also includes providing an exiting stream of the drying gas exiting the drying chamber at 56. The exiting stream 28, described above, carries the dry toner particles out of the drying chamber 14.

The method also includes producing exiting forces on the toner particles in the circulating flow of drying gas at 60, for urging the toner particles to exit the dryer as described above. Further, producing centrifugal forces on the toner particles in the curved portion of the circulating flow of drying gas for urging the toner particles to remain in the circulating flow of drying gas within the dryer at 62. The centrifugal forces oppose the exiting forces as described above. The magnitudes of the centrifugal forces are proportional to the amounts of moisture retained by the toner particles as described above.

The method also includes moving the toner particles from the drying chamber via the exiting stream at 66 when the centrifugal forces on the toner particles no longer keep the toner particles in the circulating flow of drying gas. As they dry, the wet toner particles retain less water and thus have less mass as defined below. As the mass of the wet toner particles is reduced, the centrifugal forces exerted on them, which tend to keep them in the circulating flow, are reduced. When the toner particles are dry the centrifugal forces $F_C$ can no longer keep the toner particles in the circulating stream and the exiting forces $F_E$ move the toner particles out of the drying chamber. The dry toner particles are collected in any suitable known manner such as by cyclonic collection methods or using a bag house or dust collector.

The invention provides superior results compared with conventional methods of drying toner and conventional toner drying apparatuses. Particle fusion can be significantly reduced. Toner particles dried using the invention exhibit good flow with compressibility from about 42 to about 48, and cohesivity from about 20 to about 28. Further toner particles dried using the invention exhibit desired morphology for blade cleaning at about 20 kpv. The toner particles dried in accordance with the invention are typically rougher than particles dried via conventional vacuum or plate dryers. Toner particles dried in accordance with the invention typically have significantly lower Crease MFT than the same toner dried in conventional fluid bed or vacuum dryers. The Crease 80 MFT (performed via free belt nip fuser in J paper) of toner particles dried in accordance with the invention is typically about 10° C. to about 15° C. lower than those via conventional fluid bed or vacuum dryers.

The invention also provides superior deagglomeration of the toner particles 33 resulting in improved toner particle flow characteristics. Deagglomeration, occurring mostly in the drying chamber 12, exposes the surface of each particle to enable efficient heat transfer between the particle and the heated air stream 20, 22.

It has been found that deagglomeration can be controlled by changing the particles' direction of travel and changing the amount of turbulent air in the drying chamber 12. These factors change the magnitude of the particle-to-wall and particle-to-particle collision forces in the drying chamber 12. These collision forces are typically proportional to the amount of deagglomeration of the toner particles. Larger collision forces result in more deagglomeration and smaller collision forces result in less deagglomeration. Thus, the amount of deagglomeration can be controlled by changing the inlet air pressure and/or velocity, changing the inlet angle 24, and changing the size, number, and position of the inlet air nozzles 16. For example, it has been found that, with other control variables held constant, increasing the inlet air pressures and/or velocities increases deagglomeration and decreasing them decreases deagglomeration.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

What is claimed is:

1. A method of drying chemical toner particles comprising:

providing different sized wet toner particles, wherein the mass of each wet toner particle includes the mass of the toner particle and the mass of the water retained by the toner particle;

creating a circulating flow of drying gas having a curved portion in a dryer drying chamber;

adding the wet toner particles to a dryer the circulating flow of drying gas in the drying chamber;

providing an exiting stream of the drying gas exiting the drying chamber;

producing exiting forces on the toner particles in the circulating flow of drying gas for urging the toner particles to exit the dryer via the exiting stream;

producing centrifugal forces on the toner particles in the curved portion of the circulating flow of drying gas for urging the toner particles to remain in the circulating flow of driving gas, wherein the centrifugal forces oppose the exiting forces and the magnitudes of the centrifugal forces are proportional to the amounts of moisture retained by the toner particles;

drying each of the wet toner particles in the drying chamber for a drying time $T_D$, wherein $T_D$ can vary for each toner particle and is proportional to the mass of the wet toner particle;

deagglomerating the toner particles in the drying chamber;

introducing a heated drying gas into the drying chamber at an angle with respect to the circulating flow; and adjusting the angle to control the amount of deagglomeration of the toner particles in the drying chamber.

2. The method of drying toner particles defined in claim 1 wherein $T_D$ is proportional to the amount of moisture retained by each wet toner particle so that a wet toner particle retaining more water is dried for a longer drying time than a wet toner particle retaining less water.

3. The method of drying toner particles defined in claim 1 wherein the toner particles include styrene-acrylate.

4. The method of drying toner particles defined in claim 1 wherein the toner particles include polyester.

5. The method of drying toner particles defined in claim 1 wherein the toner particles are temperature sensitive in that they can fuse together at temperatures greater than Tg.

6. The method of drying toner particles defined in claim 1 wherein the drying chamber is toroidal in shape.

7. The method of drying toner particles defined in claim 1 wherein $T_D$ is about 0.1 seconds to about 3 seconds.

8. A method of drying chemical toner particles comprising:

providing different sized wet toner particles, wherein the mass of each wet toner particle includes the mass of the toner particle and the mass of the water retained by the toner particle;

creating a circulating flow of drying gas having a curved portion in a dryer drying chamber;

adding the wet toner particles to the circulating flow of drying gas in the drying chamber;

providing an exiting stream of the drying gas exiting the drying chamber;

producing exiting forces on the toner particles in the circulating flow of drying gas for urging the toner particles to exit the dryer via the exiting stream;

producing centrifugal forces on the toner particles in the curved portion of the circulating flow of drying gas for urging the toner particles to remain in the circulating flow of drying gas, wherein the centrifugal forces oppose the exiting forces and the magnitudes of the centrifugal forces are proportional to the amounts of moisture retained by the toner particles;

drying each of the wet toner particles in the drying chamber for a drying time $T_D$, wherein $T_D$ can vary for each toner particle and is proportional to the mass of the wet toner particle;

deagglomerating the toner particles in the drying chamber;

introducing a heated drying gas into the drying chamber at a predetermined pressure; and adjusting the pressure to control the amount of deagglomeration of the toner particles in the drying chamber.

9. The method of drying toner particles defined in claim 8 wherein the step of introducing a heated drying gas into the dryer includes introducing the heated gas at a pressure of about 1.0 pounds per square inch (psi) to about 5.0 psi.

10. The method of drying toner particles defined in claim 9, wherein the step of introducing a heated drying gas into the dryer includes introducing the heated gas at a pressure of about 1.0 psi to about 1.5 psi.

11. A method of drying chemical toner particles comprising:

providing different sized wet toner particles, wherein the mass of each wet toner particle includes the mass of the toner particle and the mass of the water retained by the toner particle;

creating a circulating flow of drying gas having a curved portion in a dryer drying chamber;

adding the wet toner particles to the circulating flow of drying gas in the drying chamber;

providing an exiting stream of the drying gas exiting the drying chamber;

producing exiting forces on the toner particles in the circulating flow of drying gas for urging the toner particles to exit the dryer via the exiting stream;

producing centrifugal forces on the toner particles in the curved portion of the circulating flow of drying gas for urging the toner particles to remain in the circulating flow of drying gas, wherein the centrifugal forces oppose the exiting forces and the magnitudes of the centrifugal forces are proportional to the amounts of moisture retained by the toner particles;

drying each of the wet toner particles in the drying chamber for a drying time $T_D$, wherein $T_D$ can vary for each toner particle and is proportional to the mass of the wet toner particle;

deagglomerating the toner particles in the drying chamber;

introducing a heated drying gas into the drying chamber at a predetermined velocity; and adjusting the velocity to control the amount of deagglomeration of the toner particles in the drying chamber.

12. The method of drying toner particles defined in claim 11 wherein the step of introducing a heated drying gas into the dryer includes introducing the heated gas at a velocity of about 3,000 feet per minute (fpm) to about 5,000 fpm.

13. The method of drying toner particles defined in claim 12 wherein the step of introducing a heated drying gas into the dryer includes introducing the heated gas at a velocity of about 3,800 fpm to about 4,200 fpm.

14. The method of drying toner particles defined in claim 1 further comprising maintaining the temperature of the exiting stream at a temperature of about 12° C. below Tg of the toner particles to about 1° C. above Tg of the toner particles.

15. The method of drying toner particles defined in claim 14 further comprising maintaining the temperature of the exiting stream at a temperature of about 8° C. below Tg of the toner particles to about 3° C. below Tg of the toner particles.

16. The method of drying toner particles defined in claim 14 wherein the step of introducing a heated drying gas into the dryer includes introducing the heated drying gas having a temperature about 15° C. to about 40° C. above the temperature of the exiting stream.

17. The method of drying toner particles defined in claim 16 wherein the step of introducing a heated drying gas into the dryer includes introducing the heated drying gas having a temperature about 20° C. to about 35° C. above the temperature of the exiting stream.

18. The method of drying toner particles defined in claim 8 wherein the toner particles include styrene-acrylate.

19. The method of drying toner particles defined in claim 8 wherein the toner particles include polyester.

20. The method of drying toner particles defined in claim 8 wherein the toner particles are temperature sensitive in that they can fuse together at temperatures greater than Tg.

21. The method of drying toner particles defined in claim 20 further comprising maintaining the temperature of the exiting stream at a temperature of about 12° C. below Tg of the toner particles to about 1° C. above Tg of the toner particles.

22. The method of drying toner particles defined in claim 21 further comprising maintaining the temperature of the exiting stream at a temperature of about 8° C. below Tg of the toner particles to about 3° C. below Tg of the toner particles.

23. The method of drying toner particles defined in claim 8 wherein the step of introducing a heated drying gas into the dryer includes introducing the heated drying gas having a temperature about 15° C. to about 40° C. above the temperature of the exiting stream.

24. The method of drying toner particles defined in claim 23 wherein the step of introducing a heated drying gas into the dryer includes introducing the heated drying gas having a temperature about 20° C. to about 35° C. above the temperature of the exiting stream.

25. The method of drying toner particles defined in claim 11 wherein the toner particles include styrene-acrylate.

26. The method of drying toner particles defined in claim 11 wherein the toner particles include polyester.

27. The method of drying toner particles defined in claim 11 wherein the toner particles are temperature sensitive in that they can fuse together at temperatures greater than Tg.

28. The method of drying toner particles defined in claim 27 further comprising maintaining the temperature of the exiting stream at a temperature of about 12° C. below Tg of the toner particles to about 1° C. above Tg of the toner particles.

29. The method of drying toner particles defined in claim 28 further comprising maintaining the temperature of the exiting stream at a temperature of about 8° C. below Tg of the toner particles to about 3° C. below Tg of the toner particles.

30. The method of drying toner particles defined in claim 11 wherein the step of introducing a heated drying gas into the dryer includes introducing the heated drying gas having a temperature about 15° C. to about 40° C. above the temperature of the exiting stream.

31. The method of drying toner particles defined in claim 30 wherein the step of introducing a heated drying gas into the dryer includes introducing the heated drying gas having a temperature about 20° C. to about 35° C. above the temperature of the exiting stream.

32. The method of drying toner particles defined in claim 1 wherein the angle is less than 90 degrees.

* * * * *